US006163978A

United States Patent [19]

Hinner

[11] Patent Number: 6,163,978

[45] Date of Patent: Dec. 26, 2000

[54] CORN DRYER

[76] Inventor: Pat S. Hinner, 1385 Rainbow Dr., Merrill, Wis. 54452

[21] Appl. No.: 09/061,500

[22] Filed: Apr. 16, 1998

[51] Int. Cl.[7] ..... F26B 17/00

[52] U.S. Cl. ..... 34/169; 34/172; 34/174; 34/182

[58] Field of Search ..... 34/168, 169, 172, 34/174, 178, 181, 182

[56] References Cited

U.S. PATENT DOCUMENTS

| | | | |
|---|---|---|---|
| 3,435,540 | 4/1969 | Sanders, Jr. et al. | 34/174 |
| 4,050,164 | 9/1977 | Campbell | 38/182 |
| 4,212,115 | 7/1980 | Adler | 34/215 |

*Primary Examiner*—Denise L. Ferensic
*Assistant Examiner*—Malik N. Drake
*Attorney, Agent, or Firm*—Nawrocki, Rooney & Sivertson, P.A.

[57] ABSTRACT

A seed corn dryer capable of being switched between a single pass mode and a dual path mode of operation. The invention includes an air supply unit adapted to delivery drying air to only one dryer plenum in a dual path mode and to both dryer plenums in a single pass mode. One air supply unit includes a supply upper plenum and a supply lower plenum with a closable air passage therebetween. The dryer includes a center plenum partitioned into upper and lower plenums, with a series of corn bins on either side. Each bin has an upper inside air door, a lower inside air door, a lower outside air door and an upper inside air door. In one single pass mode, air is forced into both upper and lower dryer plenums, then either up or down in a single pass through an individual bin, exiting to the outside. In one dual path mode, air is forced only through the upper dryer plenum, then downward through a first bin, through the lower plenum, upward through a second bin, exiting through an upper outside air door.

14 Claims, 9 Drawing Sheets

CORN DRYER

FIELD OF THE INVENTION

The present application is related to devices and methods for drying grain. Specifically, the present invention is related to devices and methods for drying seed corn.

BACKGROUND OF THE INVENTION

A variety of seed corn dryers currently exist. The two main dryer categories are single pass and dual path dryers. Seed corn is typically dried on the cob and shelled after drying. Single pass dryers use air for a single pass through the seed corn bed to be dried. The air may be heated before passing through the bed and is then typically dumped to the outside without further use. As the incoming air passes through the seed bed, the seeds nearest the air inlet lose moisture and the air gains moisture. A gradient of seed moisture is established across the depth cf the seed bed. The used, moist air has less drying power than the incoming, dry air. When seed corn is especially dry or the air is especially humid, the moisture gradient across the bed depth may move through the bed at especially slow speeds or even remain stationary, as moist air is unable to dry moist corn within a reasonable time.

Reversible single pass dryers remedy this problem by allowing the air to be directed at either the bed top or bottom. Air may be directed through the seed bed from bottom to top, substantially drying the seed bed bottom half. The air is then directed through the seed bed from top to bottom, substantially drying the seed bed top half. The need to reverse the air flow through the seed corn bed is based in part on the relative humidity of the drying air, the initial moisture content of the seed corn, the desired final moisture of the seed corn, and drying parameters set by customers.

Dual path seed corn dryers use the drying air to dry two seed corn beds. The dry air first passes through a bed of drier seed corn that has likely been in the dryer for a long time period. The air is then routed through a second bed of seed corn that is wetter, likely having been in the dryer for a shorter time period. After the drier seed corn reaches target moisture, it can be removed from the bin and replaced by new, moist seed corn from the field. In the meantime, the initial, wetter seed corn has become drier. The air can now be routed first through the now drier seed corn and then through the wet seed corn. The air is thus routed through dual paths, including a first path through a first bin containing dry corn and a second bin containing moist corn.

Seed corn dryers operate within a narrow window of time. Seed corn cannot be dried until mature and viable kernels have been produced. Even at that time, further drying in place is normally desirable. The earliest seed corn can normally be dried is the beginning of September. Seed corn cannot be dried for use as seed corn if the kernels have been damaged by frost so as to impair the viability of the seed. The end of the drying period normally occurs about the beginning of October. The seed corn drying window is thus nominally one month long, with the seed corn dryers lying unused for the remainder of the year. In the period of use, a limited number of batches or "turns" can be dried. In a conventional dual path dryer, only about six batches of corn can be dried.

Both single pass seed corn dryers and dual path seed corn dryers have desirable attributes, and both types continue to be built. Single pass dryers allow rapid drying of seed corn and more batches or turns of corn through the dryer in a given time period. Single pass dryers allow drying of corn having a high moisture content. Single pass dryers are not particularly energy efficient, dumping moderately humid air after only a single pass instead of using the remaining drying potential of the air. Dual path dryers are more fuel efficient as the heated drying air is used twice, once in each pass through the corn.

Many dual path corn dryers were built for reasons of energy efficiency out of concern for gas costs and availability. The dual path dryers can be adequate in seasons having only moderately moist corn and a long period in which to bring in the corn. In particular, dual path dryers are more suitable where there is no threat of cold weather forcing rapid harvesting of the corn. Extended mild weather allows the corn to dry in place and does not force the dryer operators to rush the drying process for fear of frost. Dual path dryers, taking a longer time to dry each batch of corn, can force farmers to leave seed corn in the field longer. If exposed to sufficiently cold weather, the seed corn can lose viability, causing the value to the corn to drop from about $25 per bushel to about $2.50 per bushel. The choice to dry corn using single pass or dual path is thus optimally based on corn moisture, the predicted weather, as well as seed corn prices and energy prices.

The choice between single pass and dual path drying has heretofore been made at the time of dryer construction rather than the time of operation. Single pass corn dryers have not heretofore been switchable to operate as dual path corn dryers. Dual path corn dryers have not heretofore been switchable to operate as single pass corn dryers. What would be desirable and has not heretofore been provided is a seed corn dryer that can operate as either a single pass dryer or a dual path dryer.

SUMMARY OF THE INVENTION

The present invention includes an improved seed corn dryer capable of operating in both single pass and dual path modes. The invention includes an air supply unit adapted to delivery drying air to only one dryer plenum in a dual path mode and to both dryer plenums in a single pass mode. The dryer includes a center plenum partitioned into upper and lower plenums, with a series of corn bins disposed on either side. Each bin has an upper inside air door, a lower inside air door, a lower outside air door and an upper outside air door. In one single pass mode, air is forced into both upper and lower dryer plenums, then either up or down in a single pass through an individual bin, exiting to the outside. In one dual path mode, air is forced only through the upper dryer plenum, then downward through a first bin, through the lower plenum, upward through a second bin, exiting through an upper outside air door.

The air supply unit preferably includes a supply upper plenum, a supply lower plenum, and multiple blowers and heaters feeding each of the supply upper and lower plenums. The air supply unit further includes a common closable aperture between the supply upper and lower plenums. A preferred air supply includes an upper aperture between the supply upper plenum and the dryer upper plenum, and a closable lower aperture between the supply lower plenum and the dryer lower plenum.

In one dual path mode, the air supply common aperture is open and the supply lower plenum closable aperture is closed. This allows air from all blowers feeding the air supply unit to flow through the open, supply upper aperture, into the dryer upper plenum, but not into the dryer lower plenum. From the dryer upper plenum the air flows down through a first bin, out into the lower plenum and up through a second bin. The lower plenum can thus be used as an air passage between two bins in the dual path mode. In one dual path mode, air from the upper plenum is directed through some bins for only a single pass and dumped to the outside. In dual path mode, single pass operations are still possible.

In one single pass mode, the air supply common aperture is closed, and the air supply lower closable aperture is open, This allows air from the air supply unit to enter both upper and lower plenums concurrently. Having the air supply common aperture closed allows the use of different temperatures in the upper and lower dryer plenums. The upper plenum can be used for top-down single pass flow at one temperature and the lower plenum can be used for bottom-up single pass flow at a second temperature.

Operators of the dryer have the flexibility to run bins in dual path or single pass modes, where the decision making can be made dynamically, based on current weather, predicted weather, corn moisture, ambient air temperature and humidity, the price of natural gas, the price of seed corn, and the amount of seed corn remaining to be dried at any given time. The flexibility provided by the present invention is superior to being locked into single pass or dual path operation at the time of construction of the seed corn dryer.

DETAILED DESCRIPTION OF THE PREFERRED EMBODIMENTS

Figure 1:
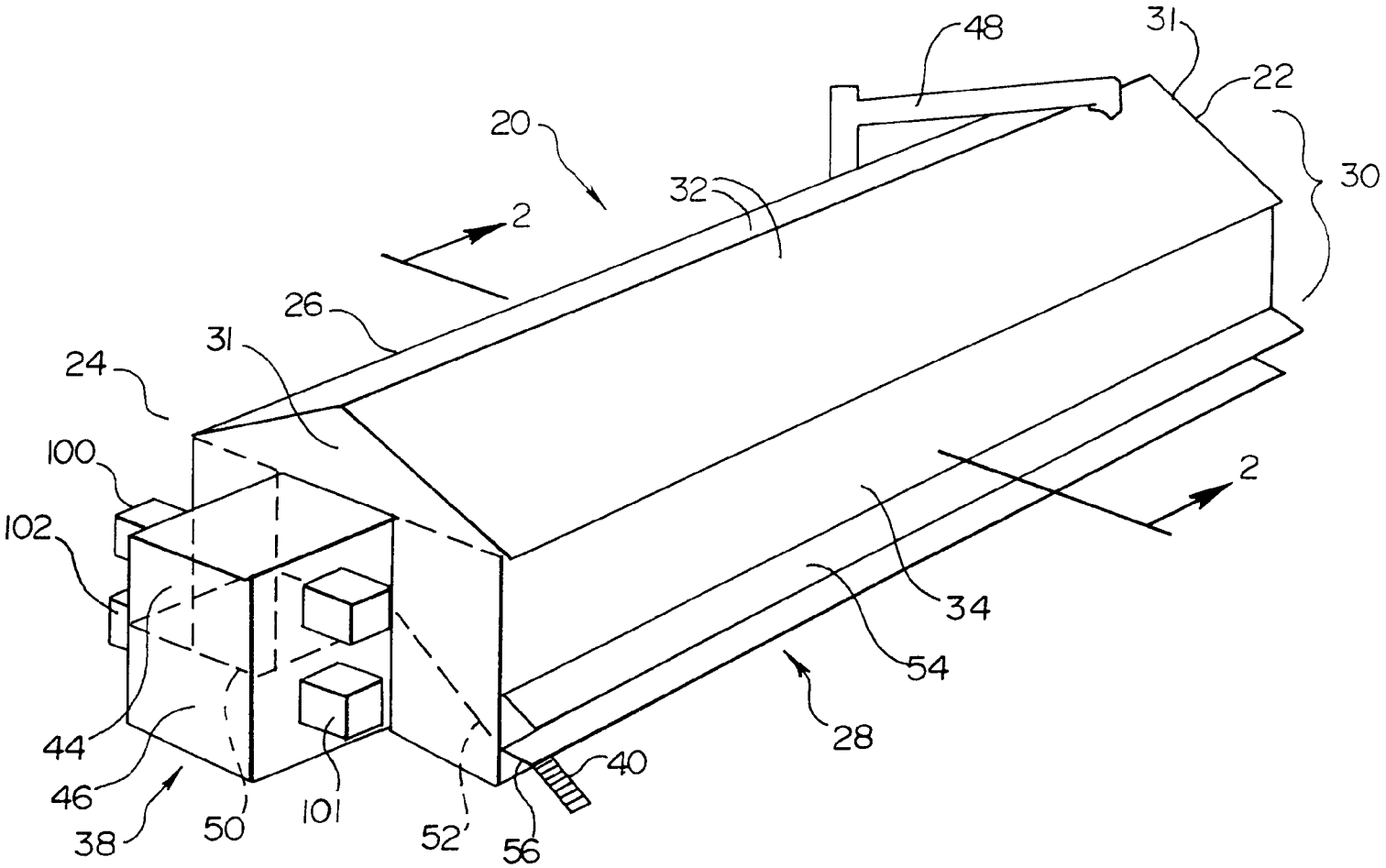
FIG. 1 is a perspective view of a seed corn dryer with an air supply unit.

FIG. 1 illustrates a seed corn dryer 20 having a front 22, a back or rear 24, a right side 26, and a left side 28. set of stairs 40 is illustrated, showing the size of a preferred embodiment of the dryer. Dryer 20 includes a shell 30 having a roof 32 and a side exterior wall 34. Dryer 20 preferably has end portions 31 open beneath roof 32 which are open to the atmosphere to allow humid air to exit upwardly from the bins within. An air supply unit 38 is disposed at the rear of dryer 20. Air supply unit 38 as illustrated includes a plurality of blowers 100, 101, and 102, a supply upper plenum 44, a supply lower plenum 46, and a partitioning floor 50 therebetween. Air supply unit 38 also includes burners (not requiring illustration) for heating the supply air. A main corn distribution incline conveyor 48 is illustrated feeding dryer 20. A bin perforated floor 52 is illustrated in phantom leading through a shellout door 83 (illustrated in FIG. 2) to a shellout conveyor 56 which is covered by a canopy 54.

Figure 2:
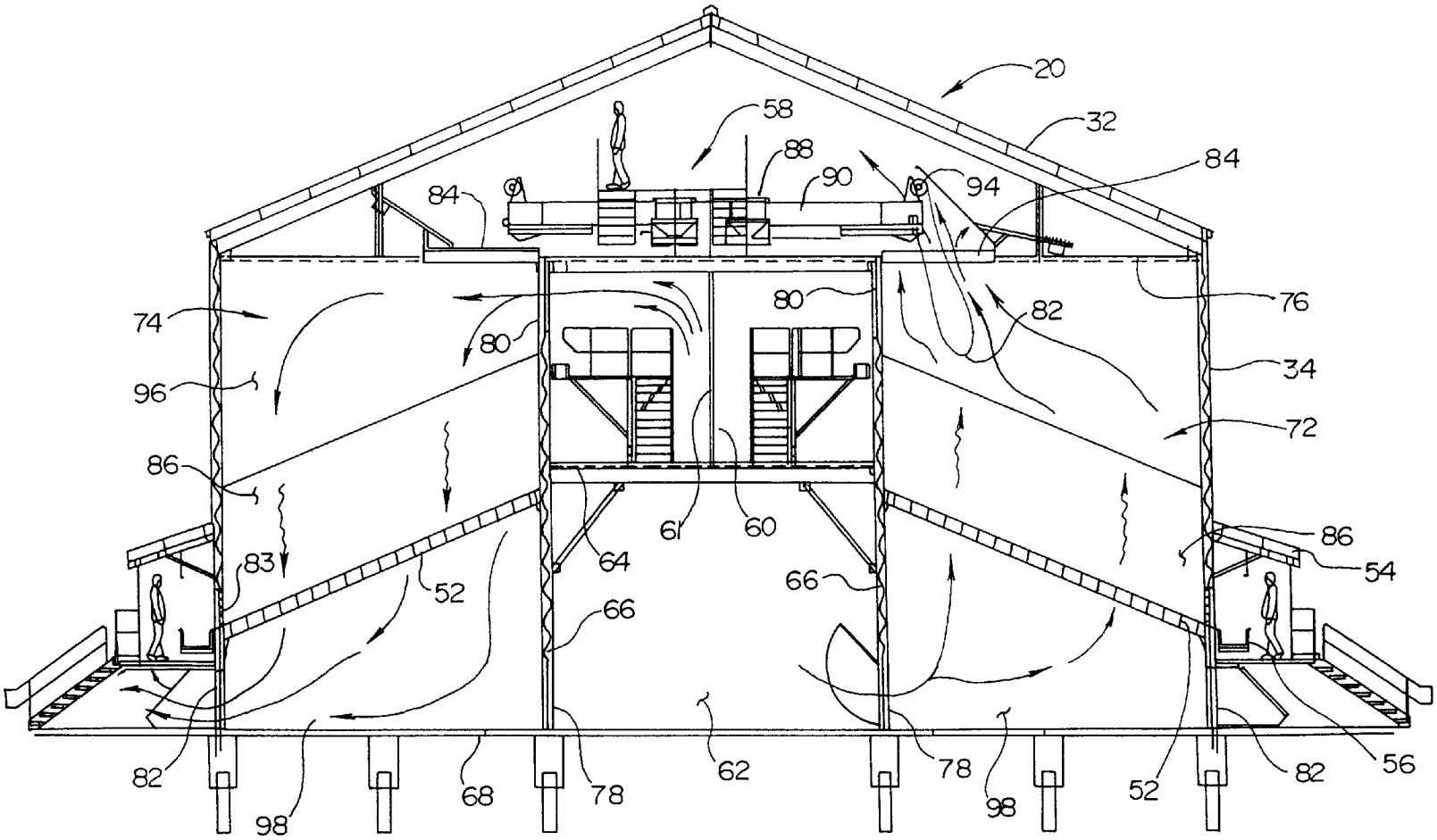
FIG. 2 is a transverse, cross-sectional view taken through 2—2 of FIG. 1, illustrating the seed corn dryer having two drying bins disposed on either side of an upper and a lower plenum, with both bins operating in a single pass mode.

Referring now to FIG. 2, dryer 20 is illustrated in transverse cross-section, including generally a corn distribution system 58, a dryer upper plenum 60 having support post 61, and a dryer lower plenum 62. Upper plenum 60 is separated from lower plenum 62 by a plenum partition 64. Lower plenum 62 is defined by a pair of oppositely disposed interior walls 66, plenum partition 64, and a floor 68. Floor 68 is supported on a foundation indicated generally at 70.

A first drying bin 72 is defined by interior wall 66, floor 68, exterior wall 34, and a bin top or ceiling 76. Each bin has several closable air apertures, preferably embodied by openings having hinged and lockable doors sealable over the openings. Bins preferably have a lower inside air door 78, an upper inside air door 80, a lower outside air door 82, an upper outside air door 84, and shellout door 83. As illustrated in FIG. 2, upper inside air door 84 is used in some embodiments to load corn into the bin. Inclined perforated floor 52 supports a bed of corn nominally about ten feet deep, and partitions the bin into an upper, storage area 96 and a lower storage or air chamber area 98.

Corn distribution system 58 includes a longitudinal conveyor 88 running the length of the dryer and a lateral conveyor 90 running to upper door 84. Corn is allowed to fall from lateral conveyor 90 to a let-down belt or web 92 which is normally kept wound on a take-up roll 94. The weight of the corn can pull belt 92 down to perforated floor 52 or to the top of corn bed 86. Belt 92, about one to two feet wide in a preferred embodiment, provides a gentle cascade of corn down to corn bed 86 rather than a large vertical free fall which can damage the kernels.

Dryer 20 in FIG. 2 is illustrated operating in reversing, single pass mode. Upper plenum 60 has heated, drying air forced within which, which passes into a second bin 74 through upper inside air door 80, down through corn bed 86, through perforated floor 52, through lower air chamber 98, exiting through lower outside air door 82. Upper outside air door 84 and lower inside air door 78 are closed in second bin 74.

First bin 72 is also illustrated while operating in single pass mode. Lower plenum 62 has heated, drying air forced within, which passes into first bin 72 through inside lower air door 78, through lower air chamber 98, up through perforated floor 52, through corn bed 86, exiting through upper outside air door 84. In a preferred mode of operation, first bin 72 illustrates bottom-up air flow through initially moist corn newly deposited in the dryer. Second bin 74 illustrates top-down air flow through corn that has been partially dried with bottom-up air flow as illustrated in bin 72.

Figure 3:
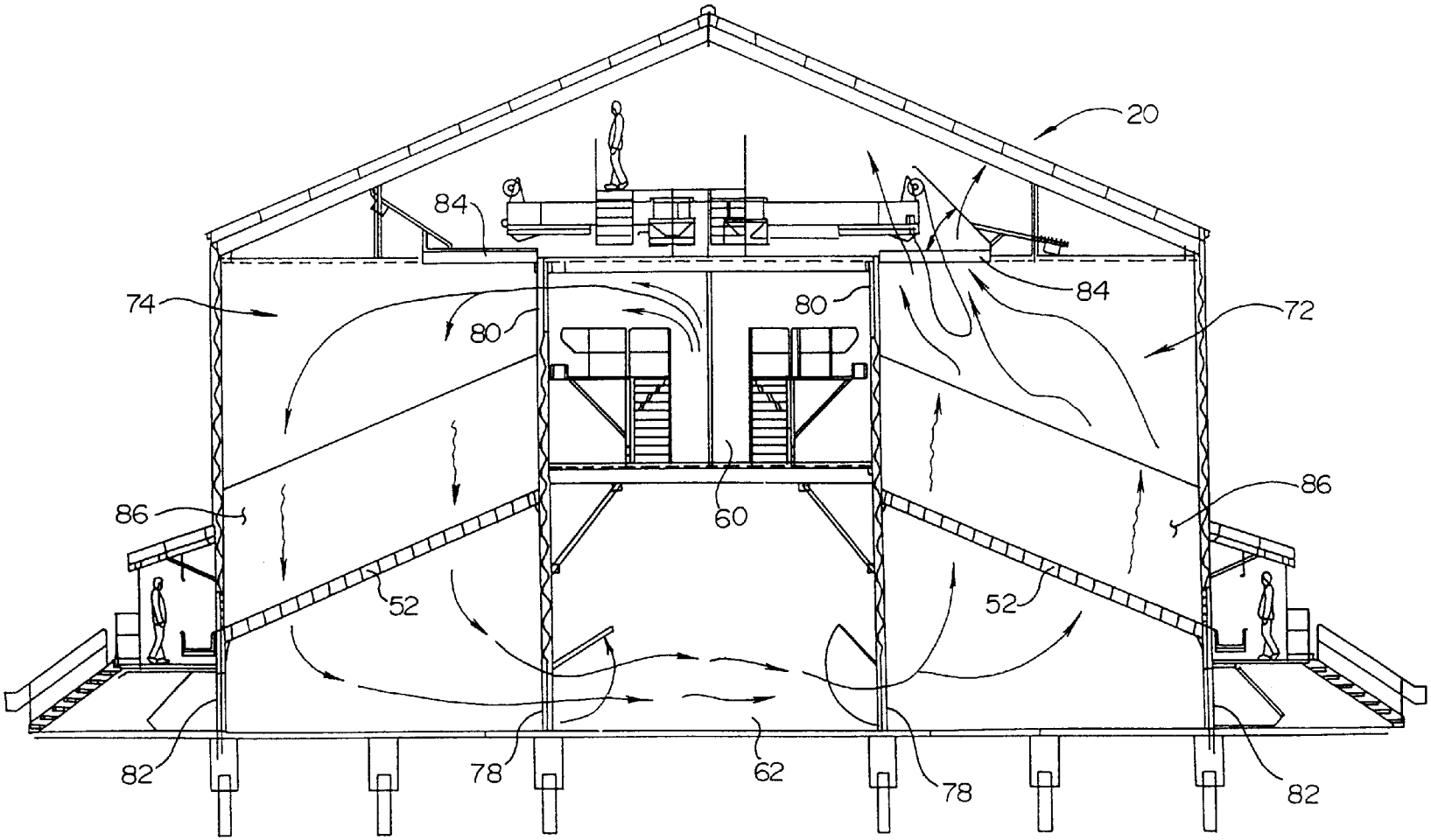
FIG. 3 is a transverse, cross-sectional view illustrating the seed corn dryer of FIG. 1 with both drying bins operating in a dual path mode.

Referring now to FIG. 3, first bin 72 and second bin 74 are illustrated operating in a dual path mode. Drying air is forced through upper plenum 60. In a preferred dual path mode of operation, no drying air is forced into lower plenum 62. Air passes from upper plenum 60 into second bin 74 through inside upper air door 80, down through corn bed 86, through lower inside air door 78, through lower plenum 62, through first bin 72 lower inside air door 78, up through corn bed 86, exiting through upper outside air door 84. Second bin 74 typically contains lower moisture corn that has already been partially dried while first bin 72 typically contains higher moisture corn recently deposited into dryer 20. Lower plenum 62 can thus serve to transport air from one bin to another in dual path mode. As lower plenum 62 is not transversely partitioned in a preferred embodiment, lower plenum 62 may also serve to mix air exiting from several bins.

Figure 4:
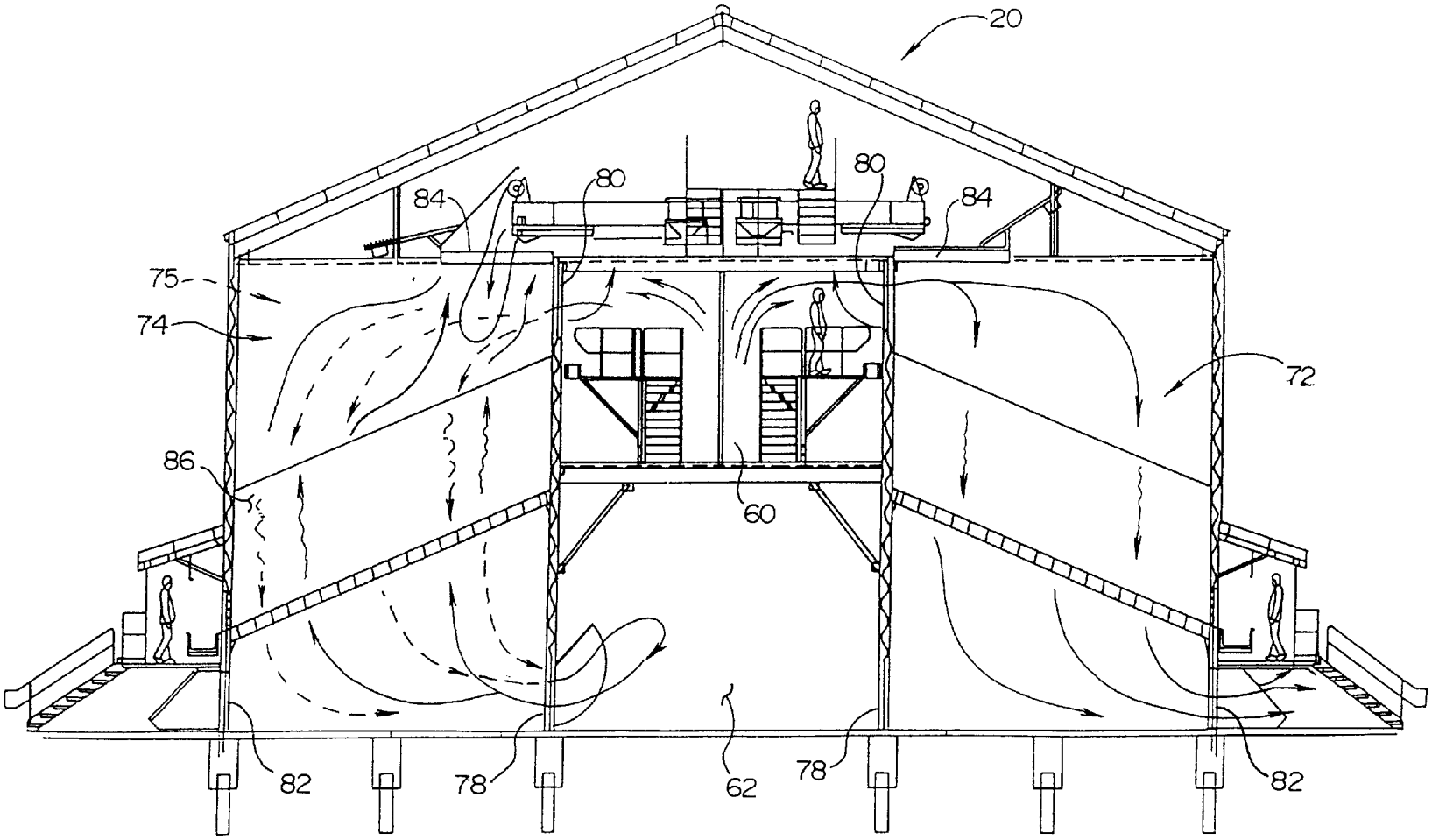
FIG. 4 is a transverse, cross-sectional view illustrating the seed corn dryer of FIG. 1 with two adjacent left bins operating in dual path mode and a right bin operating in a single pass mode.

Referring now to FIG. 4, second bin 74 is illustrated in front, with a rear, obscured third bin 75 located directly behind second bin 74. Second bin 74 and third bin 75 illustrate an alternate dual path mode. Air flow through front, visible bin 74 is indicated with solid arrows while air flow through rear, obscured bin 75 is indicated with dashed arrows. In this mode, air is forced not into lower plenum 62 but into upper plenum 60, into third bin 75 through inside upper air door 80 of bin 75, down through corn bed 86 of bin 75, out through lower inside door 78 of bin 75 and into lower plenum 62. Air can them pass into second bin 74 through lower inside door 78 of bin 74, up through corn bed 86 of bin 74, exiting through upper outside air door 84 of bin 74.

The dual path mode is achieved in FIG. 4 between bins on the same side of the plenum, unlike the bins of FIG. 3, which were on opposite sides of the plenum. In actual operation, both the dual path modes of FIG. 3 and FIG. 4 are likely to occur concurrently, as once air is dumped into lower plenum 62 after a pass through a corn bed, the air will flow for the second pass into any bin having a open lower inside air door and a open upper outside air door.

Referring again to FIG. 4, first bin 72 is illustrated, operating in a single pass mode. Bin 72 illustrates further flexibility of the present invention, as concurrent dual path and single pass operation is possible. It may be desirable to dry corn in a single pass mode if the corn is especially moist or if there is a need to rapidly partially dry a bin of corn to allow the bin to be placed first in line in a dual path mode to balance the dryer operation.

Figure 5:
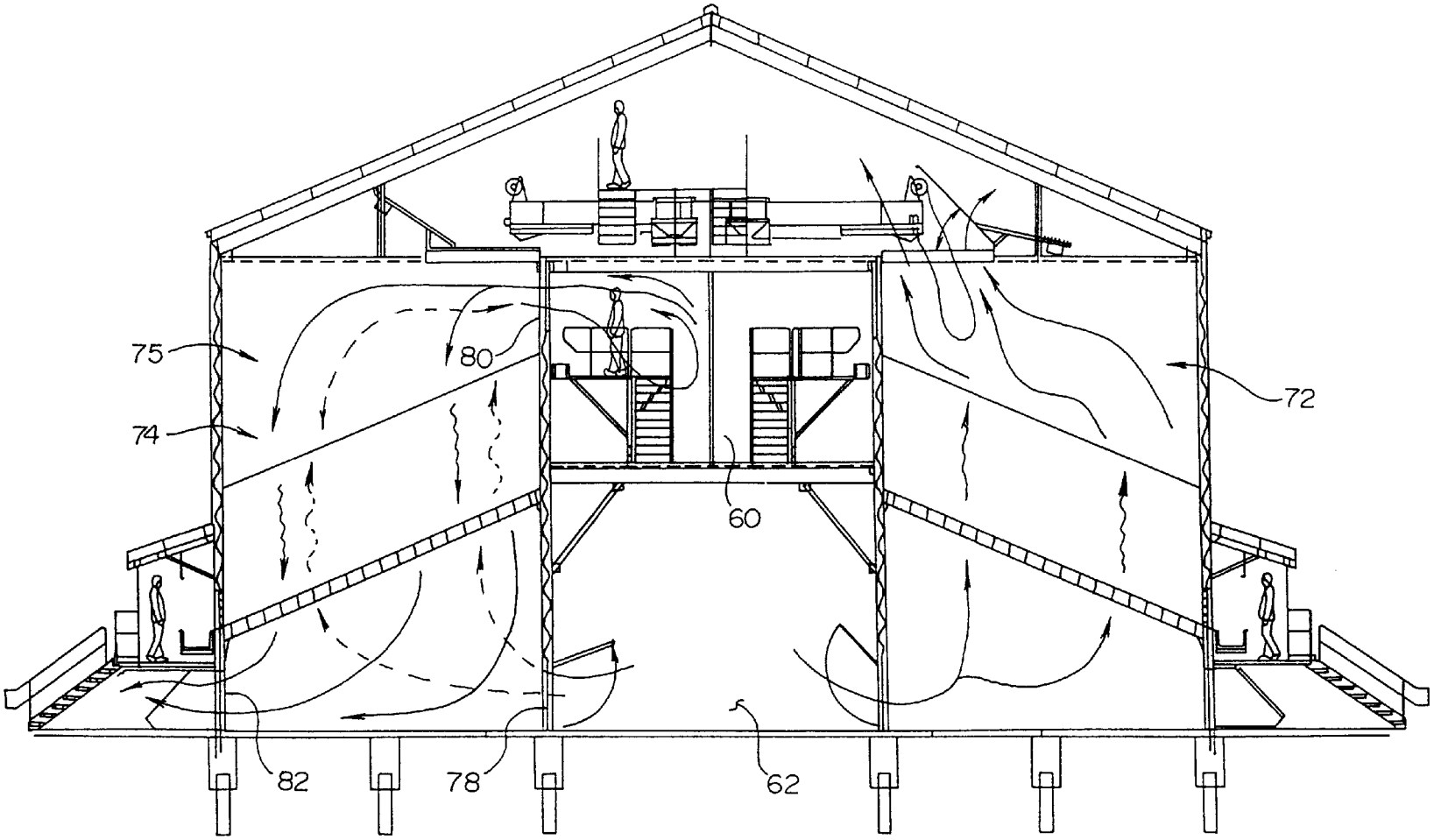
FIG. 5 is a transverse, cross-sectional view illustrating the seed corn dryer of FIG. 1 with two adjacent left bins operating in dual path mode and a right bin operating in a single pass mode.

Referring now to FIG. 5, yet another mode of operation is illustrated, with air being forced not into upper plenum 60 but into lower plenum 62. First bin 72 is being operated in a bottom-up, single pass mode. Second bin 74 and rear, obscured third bin 75 are being operated in a dual path mode, with air flowing from lower plenum 62 through lower inside door 78 of third bin 75, upward through bin 75, out upper inside air door 80, into upper plenum 60, into upper inside air door 80 of second bin 74, downward through bin 74, exiting through lower outside air door 82 of bin 74.

Figure 6:
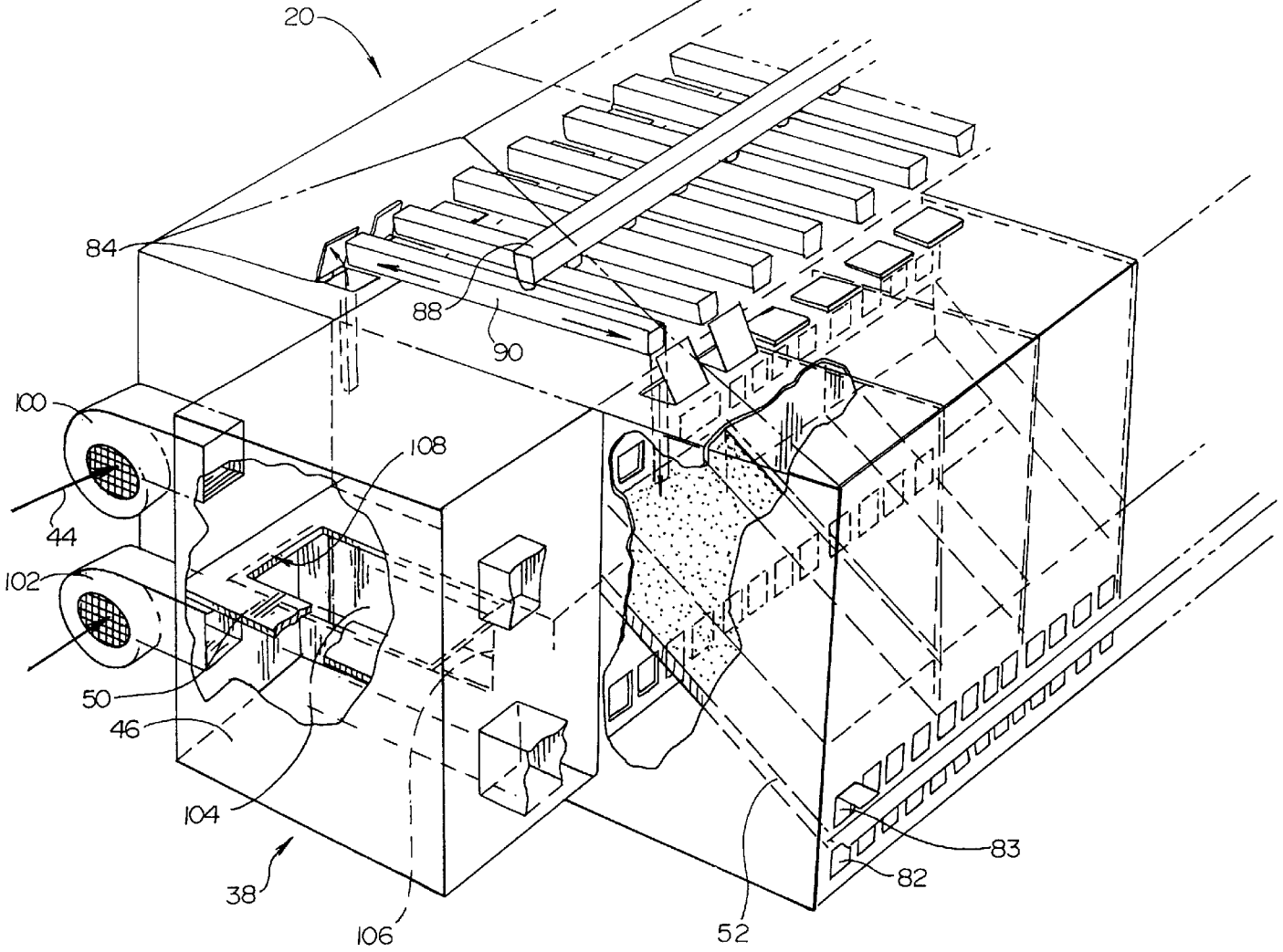
FIG. 6 is a perspective, cutaway view of a back portion of the corn dryer of FIG. 1, illustrating the air supply unit and corn distribution system.

Referring now to FIG. 6, air supply unit 38 is illustrated in more detail. Upper plenum 44, lower plenum 46, and plenum partition floor 50 are illustrated, with an upper blower 100 directly feeding upper plenum 44 and a lower blower 102 directly feeding lower plenum 46. Plenum partition 50 has a common, closable aperture 104 shared by both upper plenum 44 and lower plenum 46, providing air communication therebetween. In a preferred embodiment, a door 106 is hingedly mounted so as to close common aperture 104 in a first position and open common aperture 104 in a second position. Movement of door 106 is indicated by arrows at 108. In a preferred embodiment, while in the second position allowing air flow through common aperture 104, door 106 also blocks air flow from air supply lower plenum 46 to dryer lower plenum 62. In this embodiment, while in a single pass state, door 106 closes common aperture 104 such that air from upper blower 100 enters supply upper plenum 44 and dryer upper plenum 60 (illustrated in FIG. 2). Air from lower blower 102 enters supply lower plenum 46 and dryer lower plenum 62 (illustrated in FIG. 2). In this embodiment, while in a dual path state, door 106 opens common aperture 104 and closes an aperture between supply lower plenum 46 and dryer lower plenum 62. In this dual path state, air from both blowers 100 and 102 is directed to dryer upper plenum 60. While single pass operation of some bins is possible in this dual path state, not forcing air into the lower plenum allows use of this plenum for air transfer between the first and second bins in the dual path configuration.

Figure 7:
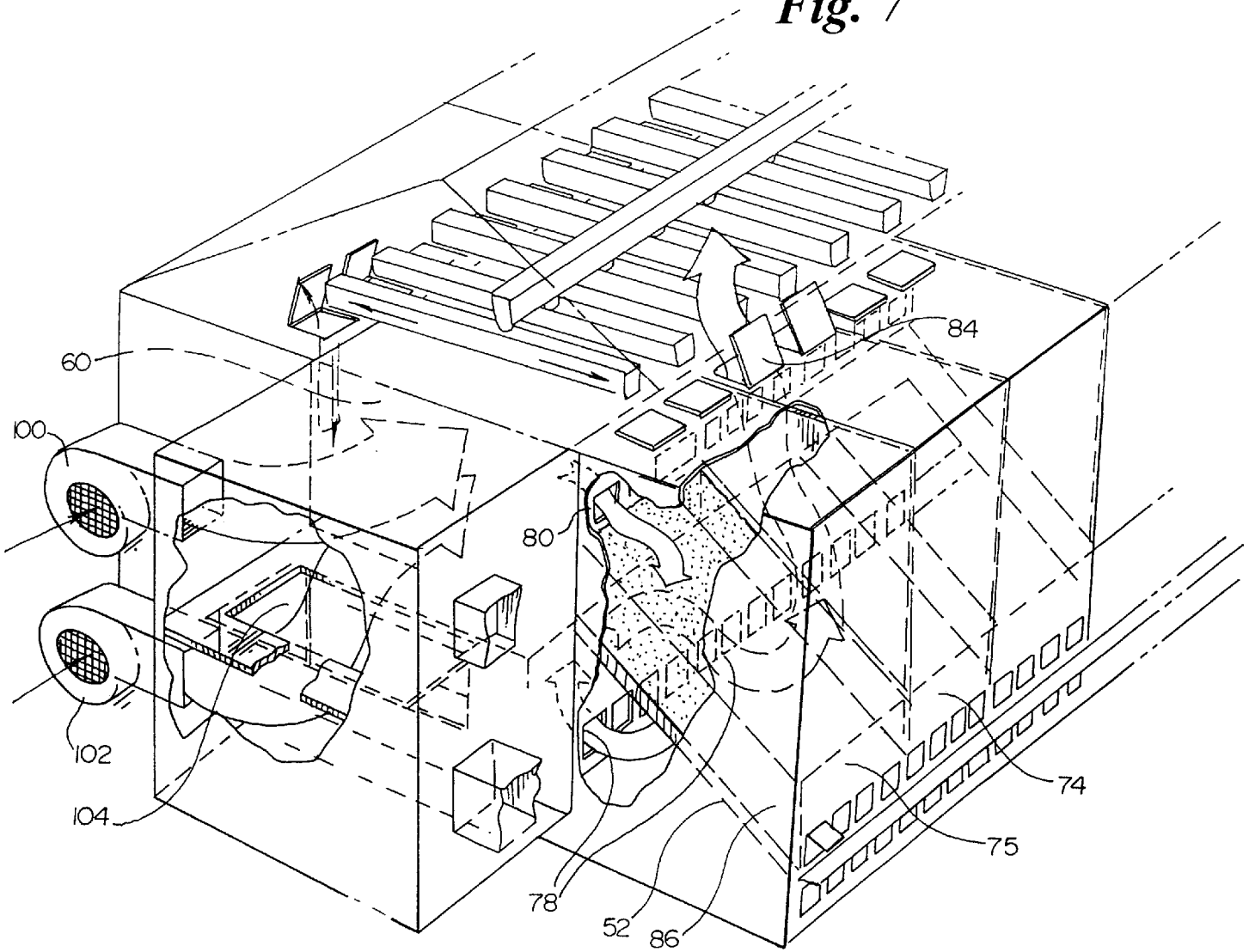
FIG. 7 is a perspective view of the back dryer portion of FIG. 6, illustrating air being supplied to the dryer upper plenum alone.

Referring now to FIG. 7, one dual path mode is further illustrated, with air flow from both blowers 100 and 102 directed into dryer upper plenum 60. Air flows into third bin 75 through upper inside air door 80, downward through the bin and contained corn, exiting the bin through lower inside air door 78, entering lower plenum 62. Air enters second bin 74 through lower inside air door 78 of bin 74, flows upward through the corn, exiting through upper outside air door 84. The dual use of upper air door 84 as an air passageway and a corn entryway is also illustrated.

Figure 8:
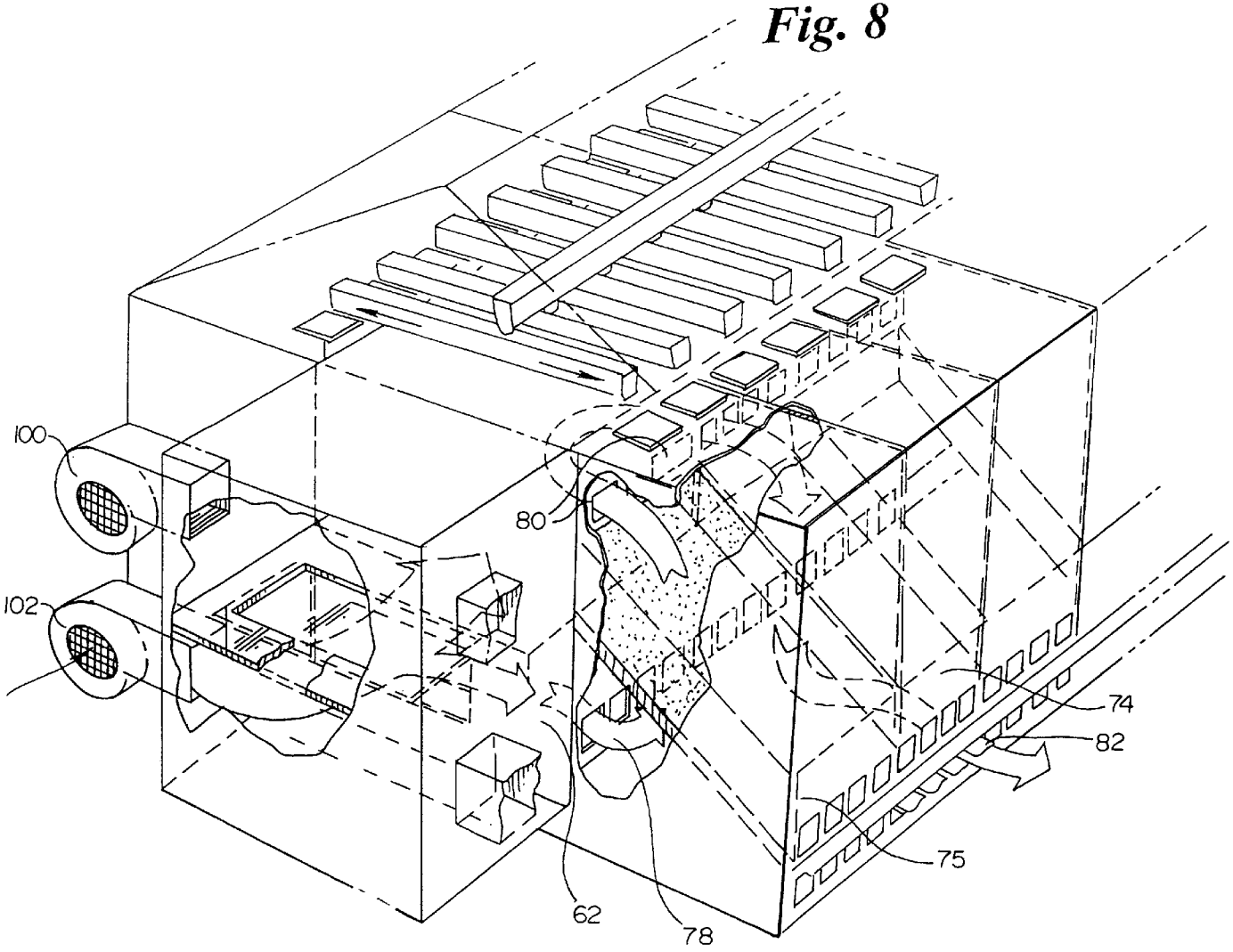
FIG. 8 is a perspective view of the back dryer portion of FIG. 6, illustrating air being supplied the lower plenum alone.

Referring now to FIG. 8, an alternate dual path mode of operation is illustrated. Air from blower 102 is directed only through dryer bottom plenum 62. Air passes into third bin 75 through lower inside air door 78, upward through the bin, exiting into upper plenum 60 through upper inside air door 80, entering second bin 74 through upper inside air door 80, passing downward through the bin, exiting through lower outside air door 82.

Figure 9:
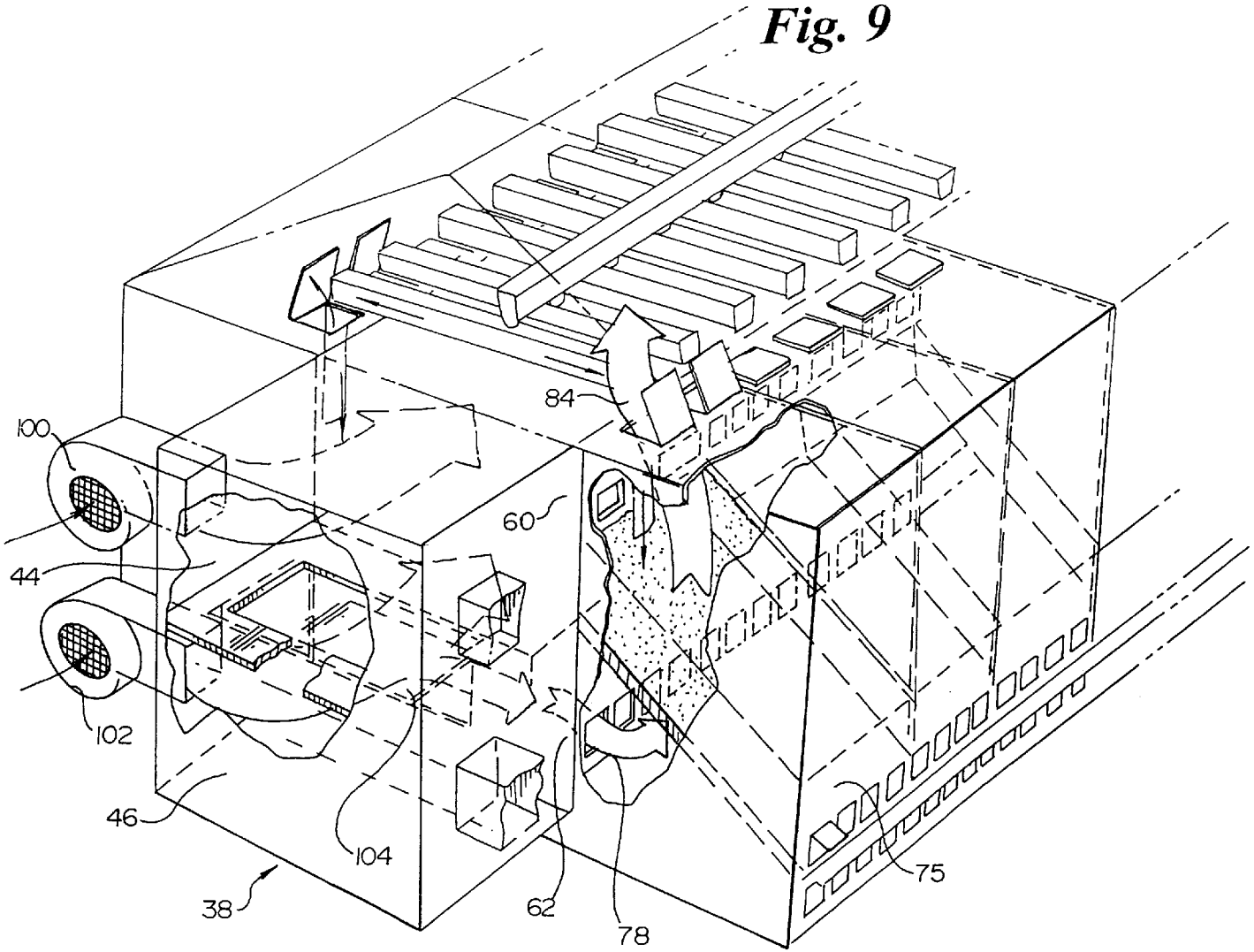
FIG. 9 is a perspective view of the back dryer portion of FIG. 6, illustrating air being supplied to both upper and lower plenums.

Referring now to FIG. 9, a single pass mode of operation is illustrated. In this mode, air passes from supply unit 38 into both dryer upper plenum 60 and dryer lower plenum 62. In one method, common aperture 104 is closed, directing air from upper blower 100 into upper plenum 60 and from lower blower 102 into lower plenum 62. Bin 75 is shown in single pass operation, having air entering through lower inside air door 78, flowing upward through the bin, and exiting through upper outside air door 84.

In use, the dryer may be operated in single pass reversing mode when the incoming corn is high in moisture, such as when the corn has a moisture content of over 40%. The dryer may be run in single pass reversing mode when the outside air humidity is especially high. The threat of bad weather or low temperatures may also force operation to single pass mode in an effort to dry more seed corn rapidly before the corn is damaged by cold.

In single pass reversing mode, a bin is filled with corn, having a nominal moisture content of 45%. Outside air is heated to about 95 degrees F and blown into the lower plenum and up through the bed of corn, exiting the bin to the outside through the bin upper air door. This drying continues until the corn is determined to be dried about halfway through the corn bed. At his point, the air flow direction through the bed can be reversed. Outside air heated to about 105 degrees F is blown through the upper plenum and down through the bed of corn, exiting to the outside through the lower outside air door. This drying can continue until the seed corn moisture is at target, about 13% moisture in a typical run.

In dual path mode, corn having a moisture content of nominally 35% is put into the first bin. Drying air is supplied from the lower plenum, having a temperature of about 95 degrees F and a relative humidity of about 55%. The drying air has typically already made a single downward pass through a bed of corn having a moisture content of between about 25% and 13%. The drying air therefore contains moisture from the corn in the bin first in line. The newly added corn in the bin is dried down to a moisture content of about 25% by the upwardly directed air. This process can take about three to four days. The newly added, moist corn is thus converted to become the old, somewhat dry corn. At this point, new, moist corn can be added to another bin and drying air introduced at a temperature of about 102 degrees F from the upper plenum downward through the corn bed. The air is then directed into the lower plenum and up through the bed of the more recently introduced moist corn. The corn can remain in the bin until the moisture is about 13%. This can take about 2 to about 4 days.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. A seed corn dryer having a front, a back, and two sides adapted to use outside air comprising:

a plurality of bins, each of said bins including a top, a bottom, a perforated floor above said bottom, a front sidewall, a back sidewall, an interior sidewall, an exterior sidewall, a bin storage space above said perforated floor, a bin lower air space beneath said perforated floor, a lower outside air door in said exterior sidewall in communication between said outside air and said lower air space, an upper outside air door in communication with said bin storage space, an upper inside air door in said interior wall in communication with said bin storage space, a lower inside air door in communication with said bin lower air space;

a dryer upper air plenum in communication with said bin upper inside air doors;

a dryer lower air plenum in communication with said bin lower inside air doors;

an air supply unit including a supply upper plenum, a supply lower plenum, at least one blower in communication with either of said supply plenums, said supply upper plenum being in communication with said dryer upper plenum, said supply lower plenum being in communication with said dryer lower plenum, said air supply unit having a first, dual path state, wherein air is supplied to said dryer upper plenum but not said dryer lower plenum, said air supply unit having a second, single pass state, wherein air is supplied to both said upper and lower dryer plenums.

2. A seed corn dryer having a front, a back, and two sides adapted to use outside air comprising:

a plurality of bins, each of said bins including a top, a bottom, a perforated floor above said bottom, a front sidewall, a back sidewall, an interior sidewall, an exterior sidewall, a bin storage space above said perforated floor, a bin lower air space beneath said perforated floor, a lower outside air door in said exterior sidewall in communication between said outside air and said lower air space, an upper outside air door in communication with said bin storage space, an upper inside air door in said interior wall in communication with said bin storage space, a lower inside air door in communication with said bin lower air space;

a dryer upper air plenum in communication with said bin upper inside air doors;

a dryer lower air plenum in communication with said bin lower inside air doors;

an air supply unit including a supply upper plenum, a supply lower plenum, at least one blower in communication with either of said supply plenums, said supply upper plenum being in communication with said dryer upper plenum, said supply lower plenum being in communication with said dryer lower plenum, said air supply unit having a first, dual path state, wherein air is supplied to said dryer upper plenum but not said dryer lower plenum, said air supply unit having a second, single pass state, wherein air is supplied to both said upper and lower dryer plenums;

and wherein said communication between said supply upper plenum and said dryer upper plenum is provided by an upper air aperture, wherein said communication between said supply lower plenum and said dryer lower plenum is provided by a closable lower air aperture, where in said air supply unit includes a common, closable air aperture between said supply upper and lower plenums, wherein said first state includes having said upper air aperture and said common air aperture open and said closable lower air aperture closed, wherein said second state includes having said upper air aperture and said closable lower air aperture open.

3. A seed corn dryer as recited in claim 2, wherein said dryer, while in said dual path state, allows air to pass from said supply upper plenum, to said dryer upper plenum, through said bin upper inside air doors into a first bin, down through said perforated floor, exiting said first bin through said lower inside air doors, passing through said dryer lower plenum, into a second bin through said lower inside air doors, up through said perforated floor, exiting said second bin through said upper outside air doors.

4. A seed corn dryer as recited in claim 2, which, while said dryer is in said single pass state, allows air to pass from said supply upper plenum to said dryer upper plenum, into a first bin through said upper inside air door, down through said perforated floor, exiting of said first bin through said lower outside air door, and which, while said dryer is in said single pass state, allows air to pass from said supply lower plenum to said dryer lower plenum, into a second bin through said lower inside air door, up through said perforated floor, exiting of said second bin through said upper outside air door.

5. A seed corn dryer having an upper plenum and a lower plenum wherein the improvement comprises:

an air supply unit including means for switchably providing air in a first state to only one of said upper or lower plenums and in a second state to said upper and lower plenums concurrently.

6. A seed corn dryer having an upper plenum and a lower plenum wherein the improvement comprises:

an air supply unit including means for switchably providing air either to said upper plenum but not said lower plenum or to said upper and lower plenums concurrently.

7. A seed corn dryer having an upper plenum and a lower plenum wherein the improvement comprises:

an air supply unit including means for switchably providing air either to said upper but not said lower plenum or to said upper and lower plenums concurrently; and where in said air supply unit includes a supply upper plenum and a supply lower plenum and said means for switchably providing air includes a first closable aperture between said supply upper and lower plenums, a second closable aperture between said supply lower plenum and said dryer lower plenum, and a third aperture between said supply upper plenum and said dryer upper plenum.

8. A seed corn dryer as recited in claim 7 wherein said supply unit includes a first door for closing said first closable aperture and a second door for closing said second closable aperture.

9. A seed corn dryer as recited in claim 7 wherein said supply unit includes a movable door having a first position for closing said first closable aperture and a second position for closing said second closable aperture.

10. A seed corn dryer as recited in claim 7 wherein said supply unit includes at least one blower in communication with said supply upper plenum and at least one blower in communication with said supply lower plenum, such that said blowers can supply air to either said dryer upper plenum alone or to said dryer upper and lower plenums concurrently.

11. A seed corn dryer adapted to use outside air comprising:

a foundation;

an exterior shell on said foundation, said exterior shell including a pair of opposite upstanding exterior sidewalls;

a pair of interior sidewalls upstanding from said foundation, said interior walls being spaced apart and generally parallel to said exterior sidewalls;

a plenum being located between said paired interior walls, said plenum including upper and lower plenums;

a storage area being contained between said exterior and interior walls, said storage area having a perforated floor partitioning said storage area into an upper storage area and a lower storage area, said storage area having a closable lower outside aperture in communication with said lower storage area and said outside air, a closable upper outside aperture in communication with said upper storage area and said outside air;

a closable upper inside aperture disposed between said upper plenum and said upper storage space;

a closable lower inside aperture disposed between said lower plenum and said lower storage space;

means for providing forced air in a first state to both said upper and lower plenums;

means for providing forced air in second state to said upper plenum but not to said lower plenum; and means for switching between said first state and said second state.

12. A seed corn dryer adapted to use outside air comprising:

a foundation;

an exterior shell on said foundation, said exterior shell including a pair of opposite upstanding exterior sidewalls;

a pair of interior sidewalls upstanding from said foundation, said interior walls being spaced apart and generally parallel to said exterior sidewalls;

a plenum being located between said paired interior walls, said plenum including upper and lower plenums, a storage area being contained between said exterior and interior walls, said storage area having a perforated floor partitioning said storage area into an upper storage area and a lower storage area, said storage area having a closable lower outside aperture in communication with said lower storage area and said outside air, a closable upper outside aperture in communication with said upper storage area and said outside air;

a closable upper inside aperture disposed between said upper plenum and said upper storage space;

a closable lower inside aperture disposed between said lower plenum and said lower storage space;

means for providing forced air in a first state to both said upper and lower plenums;

means for providing forced air in second state to said upper plenum but not to said lower plenum;

means for switching between said first state and said second state; and wherein said dryer includes an air supply unit having at least one blower, a closable aperture to said lower plenum, and an aperture to said upper plenum, wherein said means for providing forced air in said first state includes means for opening said closeable aperture, wherein said means for providing forced air in said second state includes means for opening said closeable aperture.

13. A seed corn dryer as recited in claim 12 wherein said air supply unit includes a supply upper plenum and a supply lower plenum and a closable common aperture therebetween and said means for providing forced air in said second state includes means for opening said common aperture, such that air from said supply lower plenum is able to enter said supply upper plenum and said dryer upper plenum.

14. A seed corn dryer as recited in claim 13 wherein said means for opening said common aperture and said means for opening supply lower aperture is a movable door having a first position for closing said common aperture while leaving said supply lower aperture open and a second position for opening said common aperture while closing said supply lower aperture.

* * * * *